US007522704B2

(12) United States Patent
Sung et al.

(10) Patent No.: US 7,522,704 B2
(45) Date of Patent: Apr. 21, 2009

(54) BATTERY-POWERED PORTABLE X-RAY IMAGING APPARATUS

(75) Inventors: Ki-Bong Sung, Goyang-si (KR); Jong-Lae Park, Seoul (KR)

(73) Assignee: POSKOM Co., Ltd., Paju-Si, Gyeonggi-Do (KR)

( * ) Notice: Subject to any disclaimer, the term of this patent is extended or adjusted under 35 U.S.C. 154(b) by 0 days.

(21) Appl. No.: 11/953,755

(22) Filed: Dec. 10, 2007

(65) Prior Publication Data

US 2008/0187104 A1 Aug. 7, 2008

(30) Foreign Application Priority Data

Dec. 11, 2006 (KR) ..... 10-2006-0125793

(51) Int. Cl.
*H05G 1/10* (2006.01)

(52) U.S. Cl. ..... 378/102

(58) Field of Classification Search ..... 378/101, 378/102, 103, 200

See application file for complete search history.

(56) References Cited

U.S. PATENT DOCUMENTS 3,878,394 A * 4/1975 Golden ..... 378/102
4,920,554 A * 4/1990 Gabbay et al. ..... 378/200

* cited by examiner

*Primary Examiner*—Courtney Thomas
(74) *Attorney, Agent, or Firm*—Lowe Hauptman Ham & Berner

(57) ABSTRACT

A battery-powered x-ray imaging apparatus uses a battery with a reduced capacity as a power source. The x-ray imaging apparatus includes a DC-AC converting part for converting a direct current of a battery to an alternating current, a high-voltage transformer for increasing a magnitude of the alternating current to output a high-voltage alternating current, an AC-DC converting part for converting the high-voltage alternating current to a high-voltage direct current, and an x-ray tube having an anode terminal and a cathode terminal electrically connected to the AC-DC converting part. The x-ray tube is designed to generate x-rays by allowing electrons emitted from the cathode terminal to impinge on the anode terminal. The DC-AC converting part, the high-voltage transformer, the AC-DC converting part and the x-ray tube are sealingly received within the housing part filled with oil.

5 Claims, 7 Drawing Sheets

BATTERY-POWERED PORTABLE X-RAY IMAGING APPARATUS

RELATED APPLICATIONS

The present application is based on, and claims priority from, Korea Application Number 10-2006-0125793, filed Dec. 11, 2006, the disclosure of which is hereby incorporated by reference herein in its entirety.

FIELD OF THE INVENTION

The present invention relates to an x-ray imaging apparatus and, more particularly, to a battery-powered x-ray imaging apparatus using a battery with a reduced capacity as a power source.

BACKGROUND OF THE INVENTION

An x-ray imaging apparatus refers to an instrument that diagnoses a health condition by passing x-rays generated in an x-ray tube through a body of a human patient or an animal. The x-ray tube is provided with cathode and anode terminals and designed to generate the x-rays by allowing thermal electrons emitted from the cathode terminal to strongly impinge on the anode terminal. A high voltage needs to be developed between the anode terminal and the cathode terminal in order to ensure that the thermal electrons emitted from the cathode terminal strongly impinge on the anode terminal.

Shown in FIG. 1 is a functional block diagram of a portable x-ray imaging apparatus 1. Referring to FIG. 1, an AC-DC converting part 2 receives a commercial alternating current and then converts the same to a direct current. A DC-AC converting part 3 serves to convert the direct current to a high-frequency alternating current. A high-voltage transformer 4 transduces the high-frequency alternating current to a high-voltage alternating current. An AC-DC converting part 5 reconverts the high-voltage alternating current to a direct current which in turn is supplied to an x-ray tube 6 for generating x-rays.

A sensor part 7 senses the magnitude of a voltage applied to the x-ray tube 6 and supplies a signal indicative of the sensed voltage magnitude to a voltage control part 8. Furthermore, the sensor part 7 senses the magnitude of a current flowing through the x-ray tube 6 and supplies a signal indicative of the sensed current magnitude to a current control part 9. Based on the sensed voltage magnitude, the voltage control part 8 controls the magnitude of the voltage applied to the x-ray tube 6. The voltage control part 8 generates a pulse signal to control a switching-on and switching-off cycle of the DC-AC converting part 3, thereby controlling the magnitude of the voltage applied to the x-ray tube 6. Based on the sensed current magnitude, the current control part 9 controls the magnitude of the current applied to a filament transformer 10 to eventually control the magnitude of the current flowing through the x-ray tube 6.

With the conventional portable x-ray imaging apparatus 1, a large quantity of heat is generated during an operation process of the high-voltage transformer 4, the AC-DC converting part 5, the x-ray tube 6 and the filament transformer 10. In an effort to easily and rapidly dissipate the heat thus generated, the respective elements 4, 5, 6 and 10 of the portable x-ray imaging apparatus 1 are hermetically sealed within a housing part 12 filled with oil.

Due to the fact that the portable x-ray imaging apparatus 1 described above uses a commercial alternating current as a drive power source, it has a limit in that it can be used only in a place where an electric outlet is provided.

FIG. 2 is a functional block diagram of a conventional battery-powered x-ray imaging apparatus 1' in which a battery is used as a drive power source. This battery-powered x-ray imaging apparatus 1' uses a battery as its drive power source to overcome the limit of the portable x-ray imaging apparatus 1 noted above.

The battery-powered x-ray imaging apparatus 1' includes a rechargeable battery 11, the electric power of which is supplied to an x-ray tube 6. In the battery-powered x-ray imaging apparatus 1', a large number of dry cells are arranged in series to provide a high voltage corresponding to that of the commercial alternating current. This increases the weight and volume of the battery-powered x-ray imaging apparatus 1', thereby reducing the portability thereof.

In recent years, a great deal of research efforts and capitals are invested in development of a battery-powered x-ray imaging apparatus which is light in weight and small in size. In particular, such an investment is concentrated on development of a small-sized and lightweight battery-powered x-ray imaging apparatus operable at a low voltage.

If a high-voltage battery is used in a battery-powered x-ray imaging apparatus that requires a constant level of electric power, the battery applies a relatively small current to a DC-AC converting part. In contrast, if use is made of a low-voltage battery, a large current flows through a current flow path extending from the battery to the DC-AC converting part. For this reason, a great loss of electric power occurs in the current flow path and a large quantity of heat is generated in the DC-AC converting part that performs a switching operation at a high speed.

SUMMARY OF THE INVENTION

In view of the above-noted and other problems inherent in the prior art, it is an object of the present invention to provide a battery-powered x-ray imaging apparatus capable of minimizing a loss of electric power occurring between a battery and a DC-AC converting part, while efficiently absorbing the heat generated in the DC-AC converting part.

With this object in view, an x-ray imaging apparatus of the present invention has the following features in configuration.

A DC-AC converting part, a high-voltage transformer, an AC-DC converting part and an x-ray tube are sealingly received within a housing part filled with oil. The housing part includes a side panel formed of a printed circuit board. The wiring distance between a capacitor and the DC-AC converting part is minimized by mounting the DC-AC converting part and the capacitor to the inner and outer surfaces of the printed circuit board. A switching element forming a part of the DC-AC converting part is kept in contact with the bus bar.

BRIEF DESCRIPTION OF THE DRAWINGS

The above and other objects and features of the present invention will become apparent from the following description of a preferred embodiment, given in conjunction with the accompanying drawings, in which.

DETAILED DESCRIPTION OF THE PREFERRED EMBODIMENTS

A battery-powered x-ray imaging apparatus in accordance with the present invention will now be described in detail with reference to the accompanying drawings.

Figure 1:
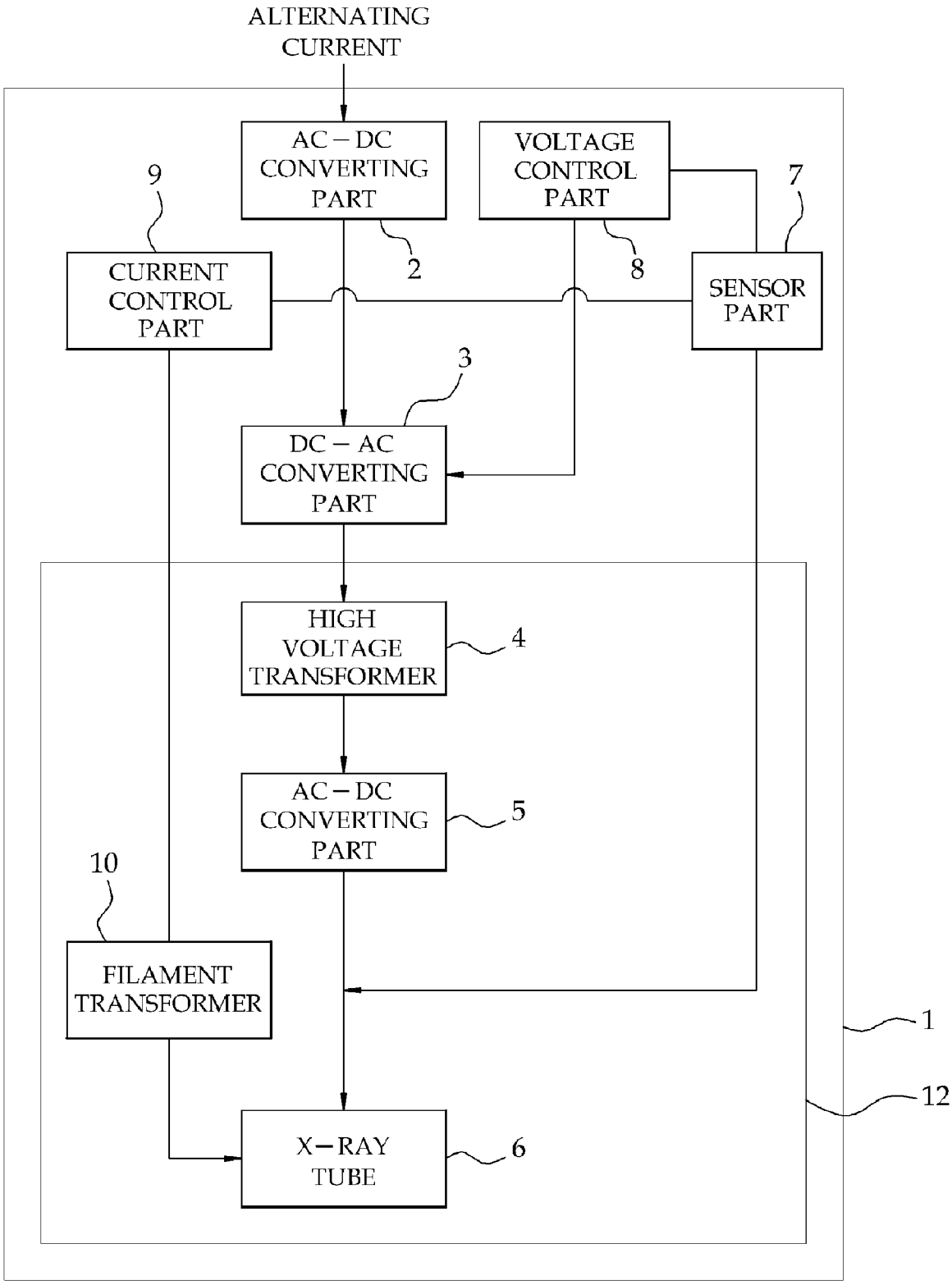
FIG. 1 is a functional block diagram showing a conventional portable x-ray imaging apparatus.
Figure 2:
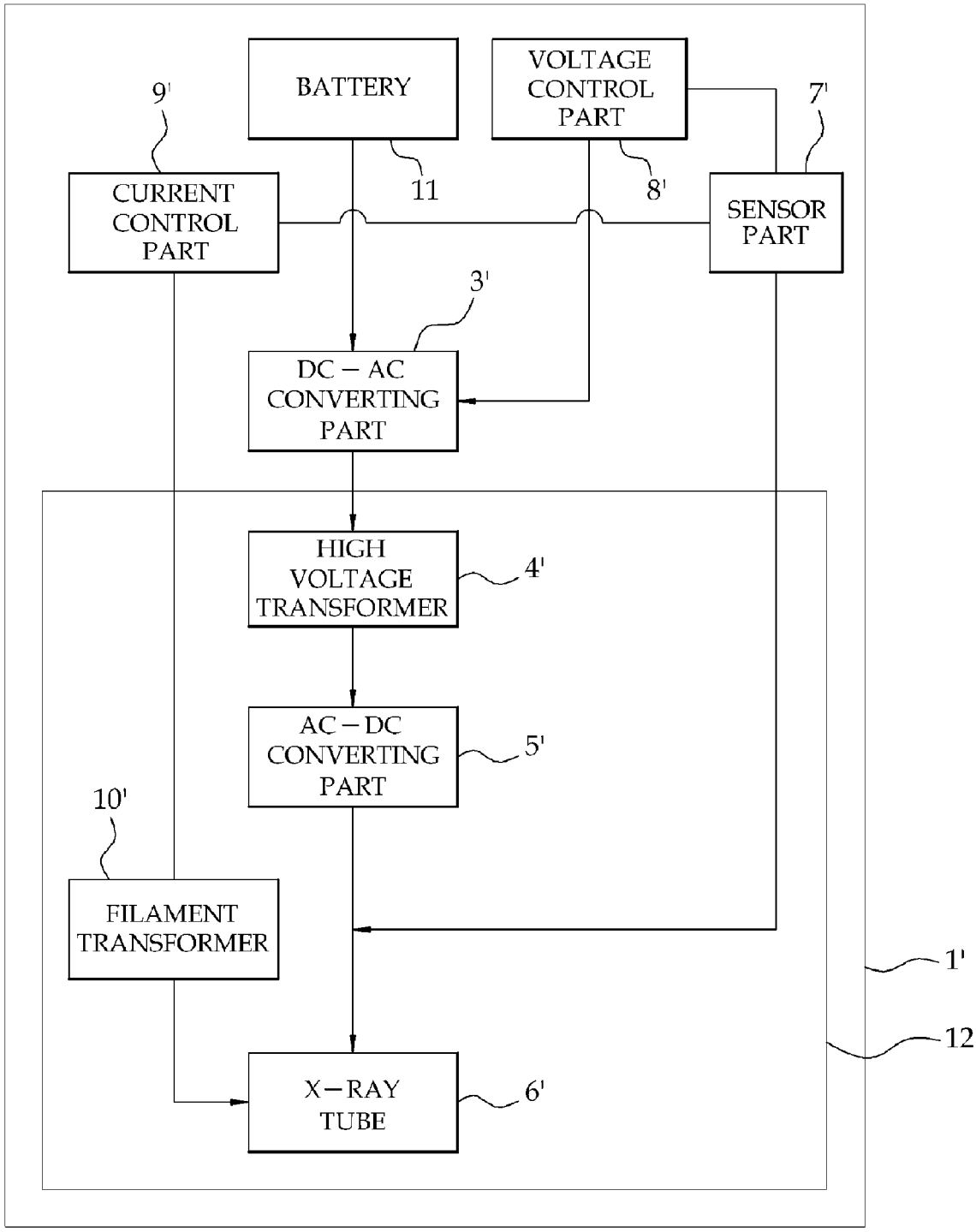
FIG. 2 is a functional block diagram illustrating a conventional battery-powered x-ray imaging apparatus.
Figure 3:
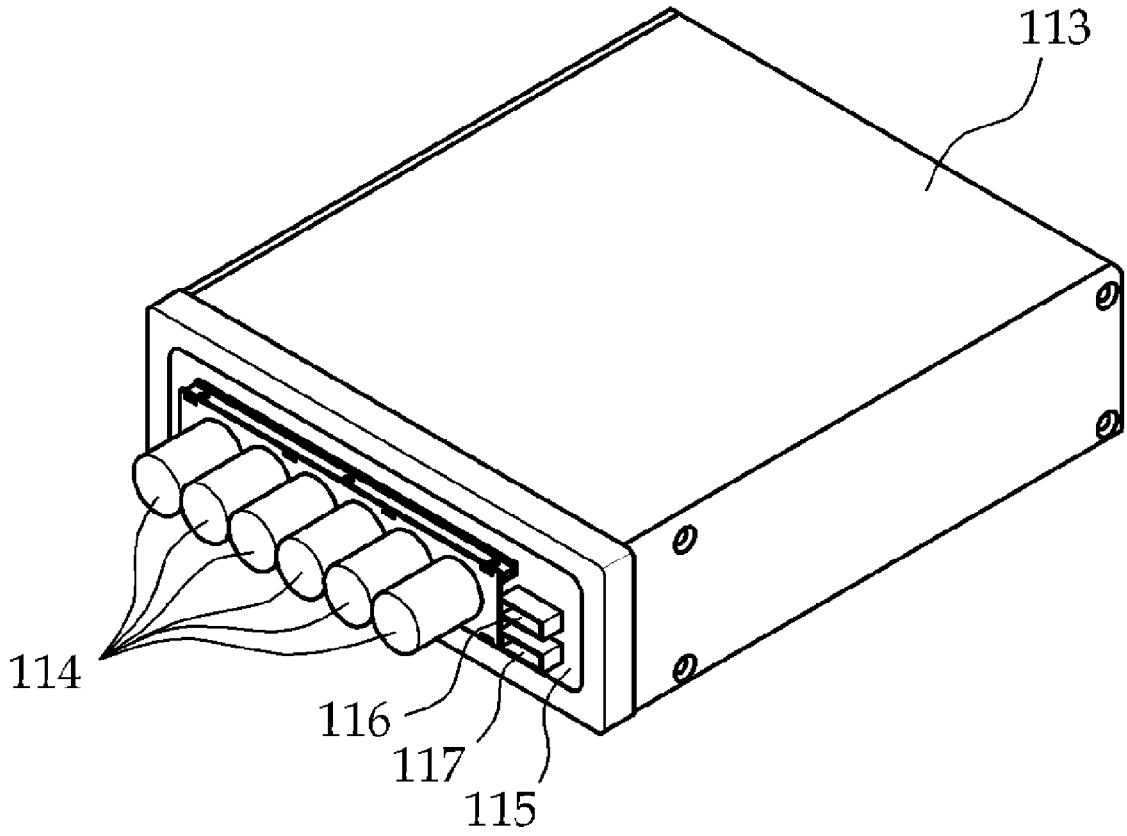
FIG. 3 is a perspective view showing a housing part of a battery-powered x-ray imaging apparatus in accordance with the present invention.
Figure 7:
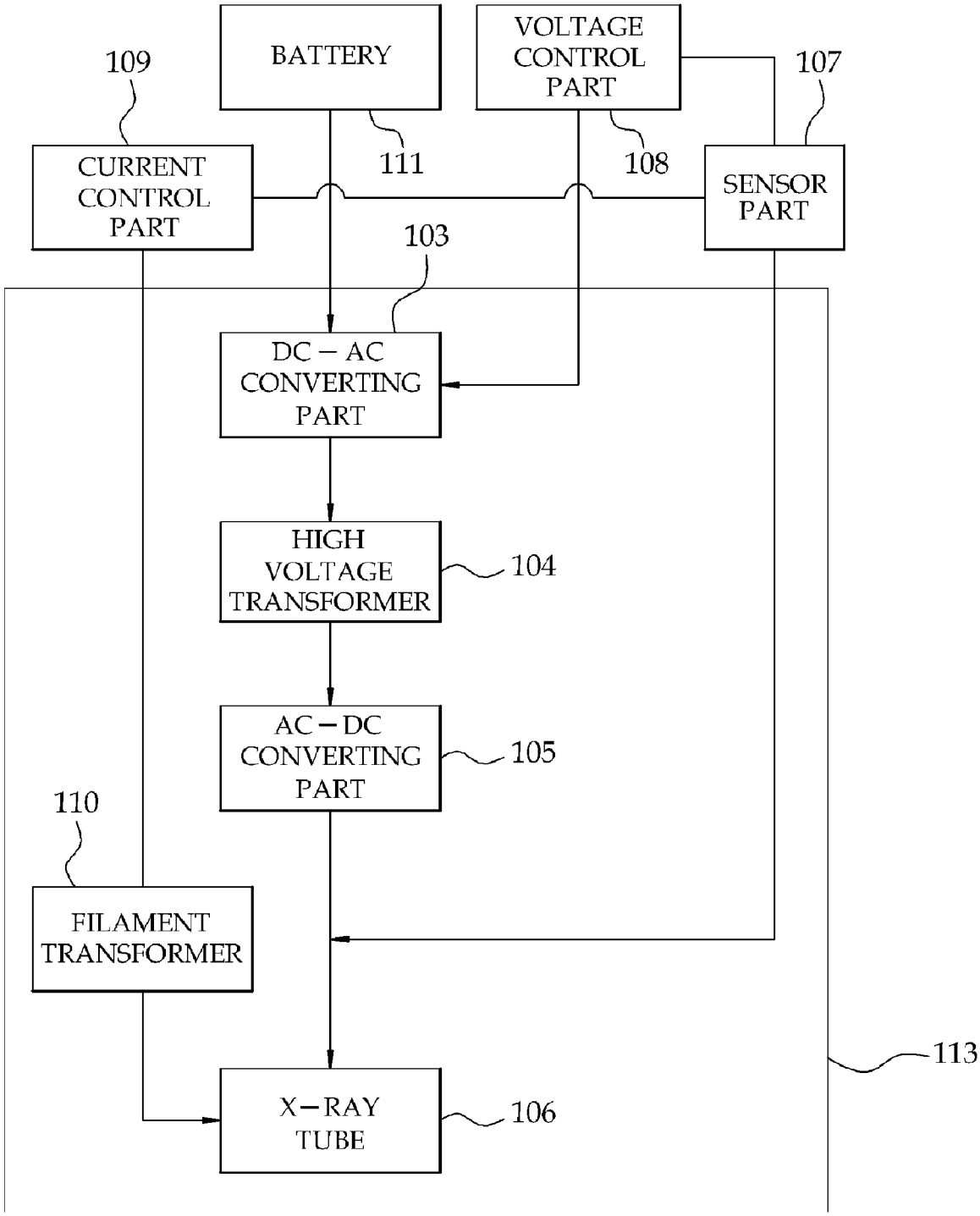
FIG. 7 is a functional block diagram illustrating a battery-powered x-ray imaging apparatus in accordance with the present invention.

FIG. 3 is a perspective view showing a housing part of a battery-powered x-ray imaging apparatus in accordance with the present invention. FIG. 7 is a functional block diagram illustrating a battery-powered x-ray imaging apparatus in accordance with the present invention. Referring to FIGS. 3 and 7, a battery-powered x-ray imaging apparatus includes a housing part 113 to which a side panel 115 is attached by a fixing means such as soldering or screws to seal up the housing part 113. The side panel 115 of the housing part 113 comprises preferably a printed circuit board.

A plurality of capacitors 114 and connectors 116 and 117 are attached to the outer surface of the side panel 115 of the housing part 113. The capacitors 114 serve to charge a direct current supplied from a battery 111 arranged outside the housing part 113 and discharge a stabilized direct current of specified magnitude to a DC-AC converting part 103. The connectors 116 and 117 serve to transmit electric signals between the inside and outside of the housing part 113. For example, an electric signal indicating the magnitude of a voltage applied to an x-ray tube 106 received within the housing part 113 and an electric signal indicating the intensity of a current flowing through the x-ray tube 106 are transmitted to a sensor part 107 arranged outside the housing part 113 through the connector 116. A control signal generated in a current control part 109 to control the intensity of a current flowing through the x-ray tube 106 is transmitted to a filament transformer 110 arranged inside the housing part 113 through the connector 117.

Figure 4:
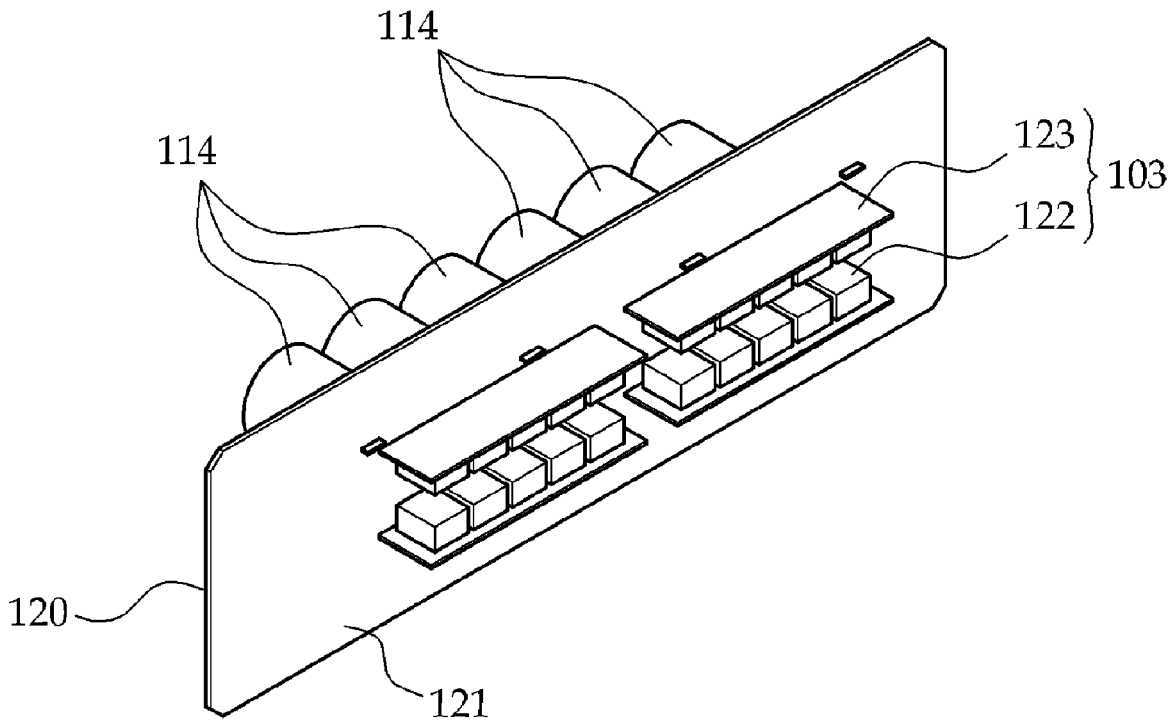
FIG. 4 shows the details of a side panel which forms a part of the housing part.

FIG. 4 shows the details of the side panel 115 (shown in FIG. 3) which forms a part of the housing part 113. Referring to FIG. 4, the capacitors 114 are attached to the outer surface 120 of the side panel 115. Components constituting the DC-AC converting part 103 are attached to the inner surface 121 of the side panel 115. The side panel 115 is preferably a printed circuit board, in which case the capacitors 114 and the DC-AC converting part 103 are mounted to the opposite surfaces, respectively thereof. The length of wiring lines running between the capacitors 114 and the DC-AC converting part 103 can be minimized by interconnecting the capacitors 114 and the DC-AC converting part 103 through the printed circuit board with no use of external wiring lines.

The DC-AC converting part 103 includes a plurality of switching elements 122 for performing a switching operation at a high speed and a plurality of bus bars 123 remaining in contact with the switching elements 122 for supplying electric power to the switching elements 122. The switching elements 122 refer to circuit elements that are switched on and off, examples of which include a transistor, a field effect transistor (FET) and an insulated gate bipolar transistor (IGBT). Although the field-effect transistor will be described hereinbelow as an example of the switching elements 122 for performing a switching operation at a high speed, the present invention is not limited thereto and, needless to say, other equivalent circuit elements may be used depending on the applications of the present invention.

The bus bars 123 are connected to the capacitors 114 through the side panel 115 and the switching elements 122 make contact with the bus bars 123. This means that the electric current charged in the capacitors 114 can be applied to the switching elements 122 via the bus bars 123.

Figure 5:
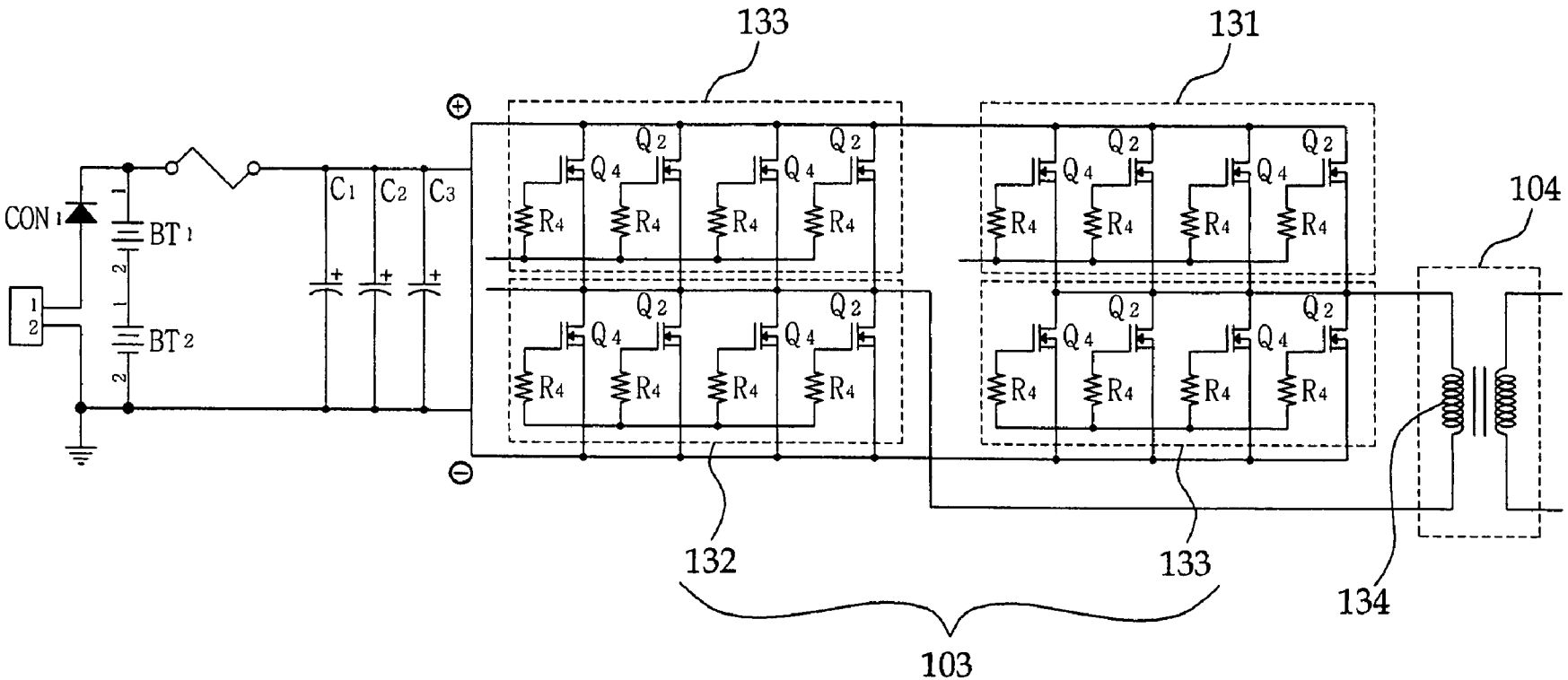
FIG. 5 is a circuit diagram for explaining one example of a DC-AC converting part in accordance with the present invention.

FIG. 5 is a circuit diagram for explaining one example of the DC-AC converting part 3 in accordance with the present invention. Referring to FIG. 5, the switching elements 122 (they are shown in this circuit diagram as Q1, Q2, Q3 and Q4) and the bus bars 123 forming the DC-AC converting part 103 are divided into first to fourth switching groups 130, 131, 132 and 133. The second and third switching groups 131 and 132 remain switched off, while the first and fourth switching groups 130 and 133 are switched on. In contrast, the second and third switching groups 131 and 132 are switched on, while the first and fourth switching groups 130 and 133 remain switched off.

As the first and fourth switching groups 130 and 133 and the second and third switching groups 131 and 132 are alternately and repeatedly switched on and off in this manner, an alternating current flows through a primary coil 134 of a high-voltage transformer 104.

Figure 6:
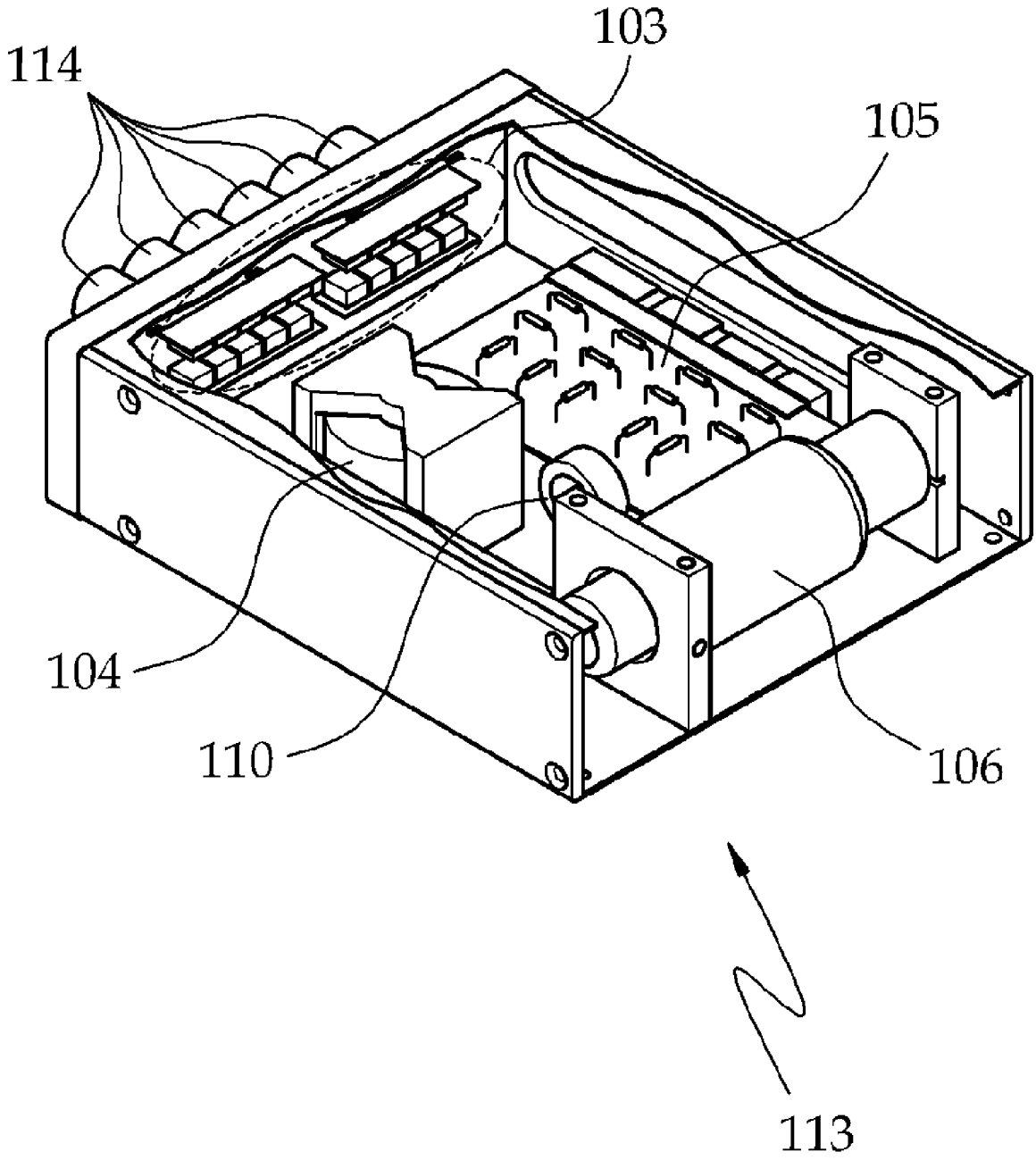
FIG. 6 is a perspective view showing an internal structure of the housing part of the battery-powered x-ray imaging apparatus in accordance with the present invention.

FIG. 6 shows an internal structure of the housing part 113 of the battery-powered x-ray imaging apparatus in accordance with the present invention. As shown in this figure, the DC-AC converting part 103, the high-voltage transformer 104, the AC-DC converting part 105, the x-ray tube 106 and the filament transformer 110 are received within the housing part 13 filled with oil and completely sealed.

The DC-AC converting part 103 is adapted to convert the direct current supplied from the capacitors 114 to an alternating current through a high speed switching operation. The high-voltage transformer 104 serves to increase the magnitude of the alternating current to thereby output a high-voltage alternating current. The AC-DC converting part 105 is designed to convert the high-voltage alternating current to a high-voltage direct current. The x-ray tube 106 has an anode terminal and a cathode terminal electrically connected to the AC-DC converting part 105. The x-ray tube 106 is designed to generate x-rays by allowing electrons emitted from the cathode terminal to impinge on the anode terminal.

In the present battery-powered x-ray imaging apparatus using a low-voltage rechargeable battery, the DC-AC converting part 103 is enclosed with the electric elements sealingly received within the housing part 113. Therefore, a large quantity of heat generated from the DC-AC converting part 103 is directly dissipated to the oil filled in the housing part 113. In particular, since the switching elements 122 constituting a part of the DC-AC converting part 103 are kept in contact with the bus bars 123, the heat generated from the switching elements 122 can be easily and rapidly dissipated to the oil filled in the housing part 113 through the bus bars 123 having the wide heat radiating surface area.

During the time when the high-frequency alternating current converted in the DC-AC converting part 103 passes through the wiring lines interconnecting the DC-AC converting part 103 and the high-voltage transformer 104, a great voltage loss occurs by the resistance component and inductance component of the wiring lines. In the present invention, the DC-AC converting part 103 and the high-voltage transformer 104 are sealingly received within the housing part 113 and are arranged as closely and compacted as possible. This helps minimize the voltage loss occurring between the DC-AC converting part 103 and the high-voltage transformer 104.

The following advantageous effects are provided by the battery-powered x-ray imaging apparatus that makes use of a low-voltage rechargeable battery.

First, the heat generated from the DC-AC converting part 103 can be easily dissipated to the oil filled in the housing part 113 by sealing and enclosing the DC-AC converting part 103, the high-voltage transformer 104, the AC-DC converting part 105 and the x-ray tube 106 within the oil-filled housing part 113.

Second, the loss of electric power occurring in the DC-AC converting part 103 and the high-voltage transformer 104 can be reduced by sealingly enclosing both the DC-AC converting part 103 and the high-voltage transformer 104 within the housing part 113 and also by minimizing the wiring distance between the DC-AC converting part 103 and the high-voltage transformer 104.

Third, the wiring length between the capacitors 114 and the DC-AC converting part 103 can be minimized and, consequently, the loss of electric power occurring in the DC-AC converting part 103 and the high-voltage transformer 104 can be reduced by mounting the capacitors 114 and the DC-AC converting part 103 to the opposite surfaces of the side panel 115 of the housing part 113 and by connecting the capacitors 114 to the DC-AC converting part 103.

Fourth, the heat generated in the switching elements 122 can be readily dissipated to the oil through the bus bar 123 by attaching the switching elements 122 forming a part of the DC-AC converting part 103 to the bus bar 123.

The embodiments set forth hereinabove have been presented for illustrative purpose only and, therefore, the present invention is not limited to these embodiments. It will be understood by those skilled in the art that various changes and modifications may be made without departing from the scope of the invention defined in the claims.

What is claimed is:

1. An x-ray imaging apparatus, comprising:

a DC-AC converting part for converting a direct current of a battery to an alternating current;

a high-voltage transformer for increasing a magnitude of the alternating current to output a high-voltage alternating current;

an AC-DC converting part for converting the high-voltage alternating current to a high-voltage direct current;

an x-ray tube having an anode terminal and a cathode terminal electrically connected to the AC-DC converting part, the x-ray tube generates x-rays by allowing electrons emitted from the cathode terminal to impinge on the anode terminal;

a housing part for sealingly receiving the DC-AC converting part, the high-voltage transformer, the AC-DC converting part and the x-ray tube, the housing part filled with oil; and a capacitor configured to charge and discharge the direct current of the battery;

wherein the housing part includes a side panel having inner and outer surfaces, the DC-AC converter part attached to the inner surface of the side panel, and the capacitor attached to the outer surface of the side panel; and wherein the side panel of the housing part is a printed circuit board configured to electrically connect the DC-AC converting part and the capacitor.

2. The x-ray imaging apparatus as recited in claim 1, wherein a connector for transmitting an electric signal to and from the housing part is attached to the side panel of the housing part.

3. The x-ray imaging apparatus as recited in claim 1, wherein the DC-AC converting part includes a switching element for performing a switching operation to convert the direct current charged in the capacitor to a high-frequency alternating current and a bus bar connected to the capacitor through the side panel of the housing part for supplying the direct current charged in the capacitor to the switching element.

4. The x-ray imaging apparatus as recited in claim 3, wherein the switching element is selected one of a field-effect transistor and an insulated gate bipolar transistor.

5. The x-ray imaging apparatus as recited in claim 3, wherein the switching element is kept in contact with the bus bar.

* * * * *